US007299769B2

(12) United States Patent
Hubbard et al.

(10) Patent No.: US 7,299,769 B2
(45) Date of Patent: Nov. 27, 2007

(54) CONDENSING GAS FIRED WATER HEATER

(75) Inventors: Michael James Hubbard, Dallas, TX (US); Mark Allen Ferguson, Keller, TX (US); Frank Austin Myers, Mansfield, TX (US); Paul James Bothner, Arlington, TX (US)

(73) Assignee: PVI Industries, LLC, Fort Worth, TX (US)

( * ) Notice: Subject to any disclaimer, the term of this patent is extended or adjusted under 35 U.S.C. 154(b) by 198 days.

(21) Appl. No.: 11/323,436

(22) Filed: Dec. 30, 2005

(65) Prior Publication Data

US 2007/0125318 A1 Jun. 7, 2007

Related U.S. Application Data

(60) Provisional application No. 60/738,815, filed on Nov. 22, 2005.

(51) Int. Cl.
*F22B 1/26* (2006.01)

(52) U.S. Cl. ..... 122/31.2; 122/18.3; 122/13.01

(58) Field of Classification Search ..... 122/31.2, 122/13.01, 18.3, 18.31, 18.4, 510; 392/451, 392/455

See application file for complete search history.

(56) References Cited

U.S. PATENT DOCUMENTS

| | | | | |
|---|---|---|---|---|
| 4,465,024 A | | 8/1984 | Adams | 122/17 |
| 4,875,465 A | * | 10/1989 | Kramer | 122/18.3 |
| 5,313,914 A | * | 5/1994 | Woollen | 122/136 R |
| 5,365,887 A | * | 11/1994 | Fenn | 122/18.4 |
| 5,970,923 A | * | 10/1999 | Nakashima | 122/494 |
| 6,223,698 B1 | * | 5/2001 | Lacaze | 122/31.2 |

OTHER PUBLICATIONS

US 5,816,596, 10/1998, Kovacs (withdrawn)*

* cited by examiner

*Primary Examiner*—Gregory Wilson
(74) *Attorney, Agent, or Firm*—Charles D. Gunter, Jr.

(57) ABSTRACT

A water heater is shown having a closed metal tank with an upwardly mounted combustion chamber and burner/blower assembly. Curved fire tubes convey the products of combustion from the chamber to an exterior mounted flue assembly. The closed tank is enclosed by a rotomolded jacket. A support stand with vertically arranged support legs supports the tank in a normally vertical position but also allows the tank to be pivoted to a horizontal position on the support stand for maintenance or repair operations.

23 Claims, 8 Drawing Sheets

CONDENSING GAS FIRED WATER HEATER

CROSS REFERENCE TO RELATED APPLICATION

The present application claims priority from provisional application Ser. No. 60/738,815, filed Nov. 22, 2005, entitled "Condensing Gas Fired Water Heater," by the same inventors.

BACKGROUND OF THE INVENTION

1. Field of the Invention

The present invention relates generally to a fire tube water heater/heating boiler having a pressurized, submerged combustion chamber and curved, submerged fire tubes, the flue products produced within the fire tubes being cooled below their dew point, causing water vapor normally entrained in combustion gases to condense to a liquid on the heating surfaces of the fire tubes.

2. Description of the Prior Art

In conventional gas/oil fired water heaters, hot gas flows through a series of vertically mounted tubes which are mounted in vertical fashion between top and bottom support plates within the water heater tank. Water flows into and out of a chamber located between the support plates and contacts and circulates about the exterior of the vertical tubes to effect heat transfer to heat the water.

Typical prior art gas/oil fired water heaters featured non-pressurized external combustion chambers. The location of the combustion chamber on the exterior of the water heater resulted in lost heat and lower combustion efficiency. The tubes and support plates were not easily accessible and required disassembly of the entire tank for maintenance and replacement.

U.S. Pat. No. 4,465,024, issued Aug. 14, 1984, to Charles L. Adams, and assigned to the assignee of the present invention introduced a new style water heater to the industry with a submerged, pressurized combustion chamber so that all combustion occurred in the water heater tank interior in a chamber surrounded by water, thereby reducing heat loss and increasing efficiency. However, the combustion chamber and burner assembly were typically horizontally mounted and the design was not a "condensing" design. The outer body of the water heater was formed of metal.

Despite the advantages offered by the design shown in U.S. Pat. No. 4,465,024, a need has continued to exist for a "condensing" water heater design which has improved packaging features including the provision of a synthetic, rotomolded jacket and enclosures.

A need has also continued to exist for such an improved water heater design having a high efficiency heat exchanger with an up-firing central combustion chamber and with improvements in the fire tubes and burner mounting assemblies.

A need has also existed for such an improved water heater design which facilitates access to the internal components of the device for maintenance or repair operations.

SUMMARY OF THE INVENTION

The gas fired water heater of the invention includes a normally closed tank containing water under pressure, the tank having a top wall, depending cylindrical sidewalls and a bottom opening, a water inlet and a water outlet. A combustion chamber assembly having a submerged, pressurized combustion chamber with multiple external heating surfaces extends through the bottom opening of the closed tank so that all of the heating surfaces are submerged in the water under pressure. A a forced draft burner assembly is mounted on the bottom opening of the closed tank and communicates with the combustion chamber for causing combustion to take place within the submerged, pressurized combustion chamber. A rotomolded jacket encloses the normally closed tank. A support stand has upwardly extending legs located on either of two sides of the closed and jacketed tank, the support stand being attached to the closed tank at a pivot point, whereby the tank is rotatable about the pivot point between a vertical position and a horizontal position.

The preferred combustion chamber comprises a substantially cylindrical body portion having an open end located adjacent the closed tank bottom opening and an opposite closed end. The multiple external heating surfaces preferably comprise a plurality curved fire tubes, the fires tubes each having a short leg joined to the closed end of the combustion chamber and a long leg which curves downwardly and exits the closed tank adjacent the bottom opening thereof. A flue collector is mounted on the exterior of the closed tank adjacent the bottom opening thereof, the flue collector having an annular chamber surrounding the exterior mounted blower and separated therefrom. The annular chamber communicates with each long leg of each of the fire tubes for collecting flue gases and condensate formed therein. The flue collector is preferably formed as a seamless lower portion with upturned walls so as to facilitate a leak free area without seams where an acidic condensate might collect.

Preferably, the water inlet of the closed tank is located on the tank sidewalls at a point proximate the exit point of the long legs of the curved fire tubes from the closed tank into the flue collector to facilitate heat transfer. At least selected ones of the curved fire tubes are provided with baffles to increase flue velocity and increase impingement of flue gases on an inner wall surface of the fire tubes. The fire tube interiors are divided into a condensing region and a non-condensing region and non-metallic plastic baffles may be located in the condensing region of the fire tube interiors. In a particularly preferred embodiment of the invention, the baffles are corkscrew in shape and may have cylindrical plastic rods placed in a condensing region of the fire tube interiors.

The preferred normally closed water storage tank is provided with a bottom mounting flange. A circular, flat metal sheet is used as a lower closure for the normally closed tank as well as for mounting the forced draft burner assembly, the flat metal sheet being gasketed and bolted to the bottom mounting flange of the tank. The burner may be equipped with a variable orifice arrangement for controlling the intake of combustion air to the combustion chamber. An electrical control panel is mounted on the rotomolded jacket by means of a floating mounting stud on the closed tank exterior cylindrical sidewalls in cooperation with a positive attachment to a flange surface molded into the rotomolded plastic jacket. The control panel can be equipped with a special hinged door arrangement which provides a positive attachment mechanism for mounting the door on the panel.

Additional objects, features and advantages will be apparent in the written description which follows.

DETAILED DESCRIPTION OF THE INVENTION

Figure 1:
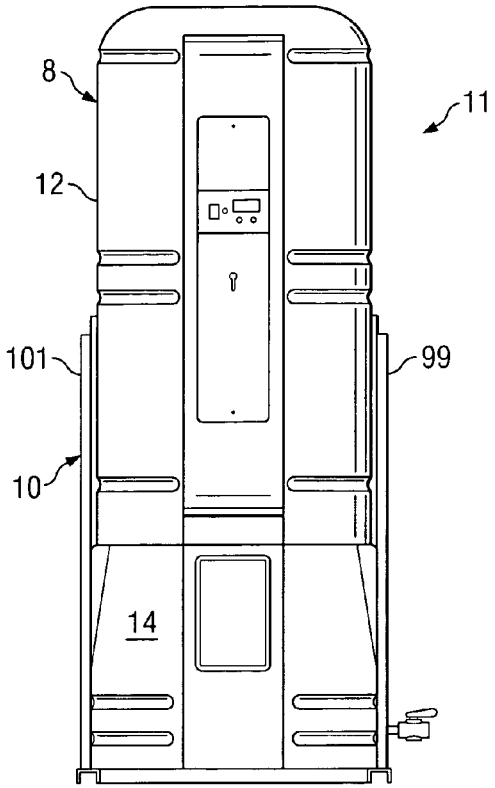
FIG. 1 is a front perspective view of the water heater of the invention.

FIG. 1 shows the water heater of the present invention designated generally as 11. The term "water heater", as used in this discussion, will be understood to encompass a heating boiler, depending upon the sizing and capacities of the various components to be described.

The water heater 11 includes a rotomolded outer jacket 8 formed from a synthetic, non-conductive material and a support stand 10 for supporting the water heater in a normal vertical operating position. In the embodiment of the invention shown in FIGS. 1 and 2, the jacket is provided as a one-piece upper section 12 and a two-piece "clam shell" lower enclosure 14. It will be understood, however, that the rotomolded outer jacket could also be comprised of several large connectible vertical segments that can be connected together to form various diameter outer enclosures. Alternatively, the rotomolded jacket design could also be comprised of two or more interlocking rotomolded rings which can be connected together to form various length outer enclosures for the water heater. The rotomolded jacket design could also comprise a clam shell upper section in conjunction with other alternate jacket elements to facilitate access to the interior of the apparatus and to thereby facilitate field service.

By providing connectable segments for the outer enclosure, additional segments can be provided and interlocked, for example, to increase the overall length or height of the jacket to accommodate a larger tank. Rotomolding will be familiar to those skilled in the relevant arts. Basically in rotational molding, the product is formed inside a closed mold or cavity where the mold is rotated biaxially in a heating chamber. To obtain the mold rotation in two planes perpendicular to each other, a spindle is rotated on a primary axis, while the mold is rotated on a secondary axis. In the loading stage, either liquid or powdered plastic is charged into a hollow mold. The mold halves are then clamped shut and moved into an oven where the loaded mold spins biaxially.

In the oven, heat penetrates the mold causing the plastic, if it is in the powder form, to become tacky and stick to the mold surface, or if it is in the liquid form, to start to gel. Usually, the heating is done by air or by liquid of high specific heat, such as molten salt. Since the mold continues to rotate while the heating is going on, the plastic will gradually become distributed evenly on the mold cavity walls through gravitational force. As the cycle continues, the synthetic material melts completely and forms a homogeneous layer of molten plastic.

When the parts have been formed, the mold is moved to a cooling chamber where cooling is accomplished by either a cold spray of water and/or forced air or liquid circulation inside the mold. The mold continues to be rotated during the cooling cycle. Additional details on rotational molding can be found in the Plastics Engineering Handbook of the Society of Plastics, Inc., 4th Edition, Ed. J. Frados, Nostrand-Reinhold Publishers, and similar references.

Figure 8:
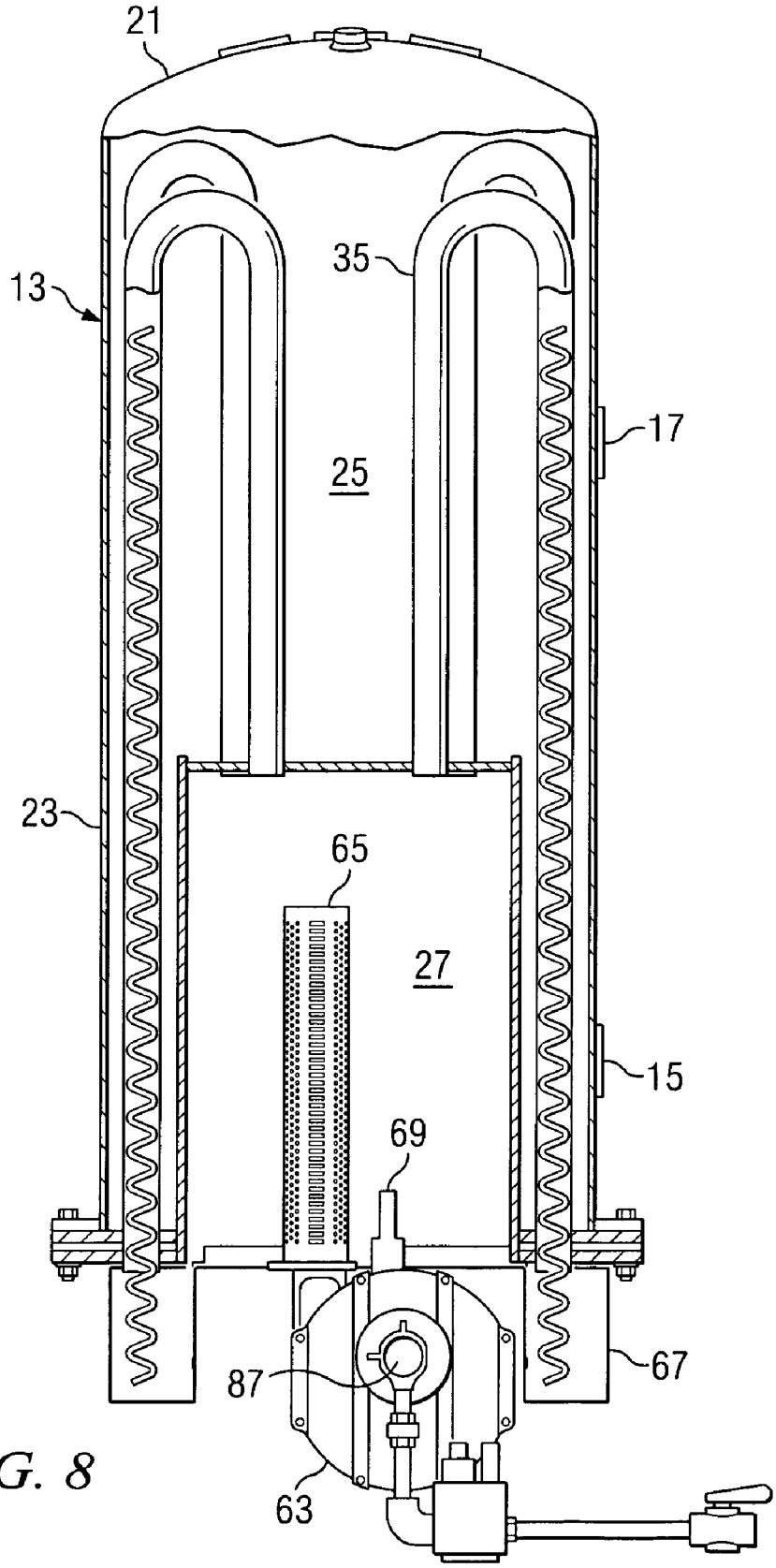
FIG. 8 is a partial, cross sectional view of the assembled water heater of FIG. 1 also showing certain of the internal components thereof.
Figure 9:
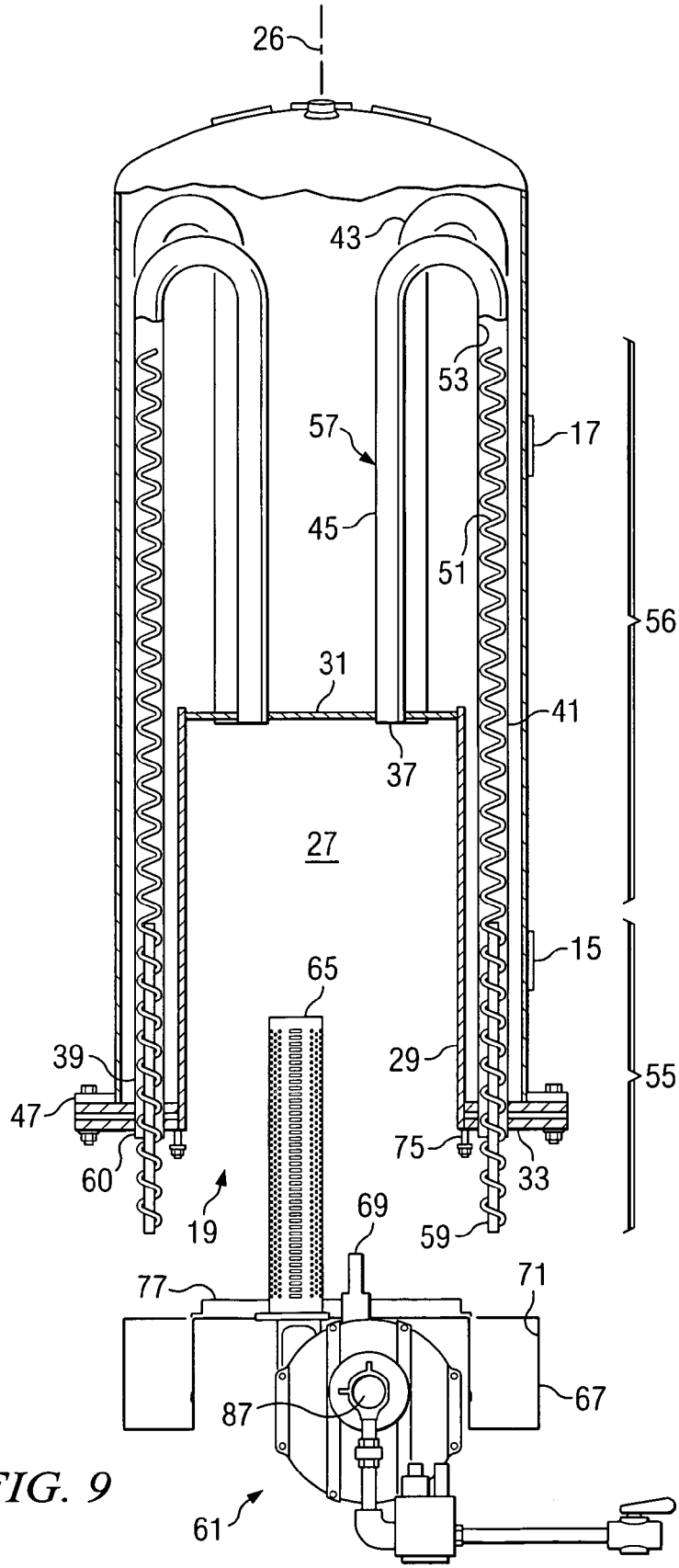
FIG. 9 is a view similar to FIG. 6, but with the burner and blower assemblies being shown in exploded fashion.

As best seen in FIGS. 8 and 9, the rotomolded jacket 8 encloses a water tank 13 of the type having a water inlet 15, a water outlet 17, and a bottom opening (generally at 19 in FIG. 9). Tank 13 can be of the conventional flanged and dish design formed of steel or other suitable metal. In one preferred form of the invention, the tank 13 is formed of 439 stainless steel. The tank will typically be provided with Applicant's proprietary Nickelshield® plating treatments followed by the application of a Polyshield® tank lining. The Nickelshield® plating is applied by an electroless, auto-catalytic submersion chemical plating process. The non-ferrous, electroless nickel plating is deposited evenly over all the vessel surfaces. The Polyshield® tank lining is a continuous coverage, thermoplastic polymer formulated with anti-oxidants and thermal stabilizers. The lining is applied in multiple, individually oven-cured coats after complete tank fabrication. The tank, which forms a normally closed tank containing water under pressure has a top wall or dome 21 and cylindrical sidewalls 23 which define an interior 25 of tank 13. The tank interior forms a water chamber for circulation of water passing into water inlet 15 and out of water outlet 17. The tank may also have applied thereto Applicant's proprietary Scaleguard® ceramic fiber refractory board insulation and be equipped with bolt-on flanges as described in Applicant's issued U.S. Pat. No. 4,968,066, issued Nov. 6, 1990, and assigned to the assignee of the present invention.

A combustion chamber assembly has a submerged chamber portion 27 which is adapted to be received within opening 19 in tank 13. The submerged chamber portion 27 comprises a cylindrical elongated member having an initially open end (29 in FIG. 9) and having an opposite closed end 31. The combustion chamber is protected by a three-step corrosion barrier. First, the steel combustion chamber is blasted down to white metal. Next, a robot precisely applies a non-ferrous copper matrix to the blasted steel. Finally, the matrix is sealed by an oven-cured PTFE polymer overcoat. The combustion chamber assembly also includes a mounting portion for detachably engaging the tank opening 19 for mounting the assembly within the tank. The mounting portion can conveniently comprise a tube mounting flange 33 located adjacent and connected to the combustion chamber open end 35 as shown in FIG. 9. The tube mounting flange 33 is a ring like body having an opening in the central part thereof which opening coincides with the opening in open end 29 of the submerged chamber portion 27. Flange 33 is securely affixed to chamber 33 as by welding or the like.

As seen in FIGS. 8 and 9, the combustion chamber assembly also includes a plurality of curved fire tubes 35 each of which has an end 37 which communicates with combustion chamber portion 27 through closed end 31 (see FIG. 9) and which has an opposite end 39 which extends through the opening 19 when in place on tank 13. Each of curved tubes 35 is characterized in that at least a portion of the length thereof is generally U-shaped. In the embodiment of the device shown in FIGS. 8 and 9, the submerged combustion chamber portion 27 of the combustion chamber assembly extends along a portion of the length of the curved fire tubes 35 creating a long leg 41 running along the exterior of the combustion chamber portion 27 and separated by U-shaped portion 43 from a short leg 45 (FIG. 9) which joins and extends through closed end 31. It will be understood that the length of combustion chamber submerged portion 27 can be varied such as by increasing the length of the chamber, thereby shortening the length of leg 45 of tubes 35.

The ends 39 of curved tubes 35, as shown in FIG. 9, preferably extend to the tube mounting flange 33 and communicate through flange 33 by means of openings with the tank exterior when the assembly 27 is received within the opening 19. The tube ends 39 are fixedly secured to flange 33 as by brazing the tube ends on the front and back sides of flange 33. Although a small number of curved tubes 35 are shown in FIGS. 8 and 9 for simplicity, a greater number of tubes and openings can be used in practice. Although solid-copper is the preferred metal for use in constructing the curved tubes 35, other acceptable materials include, for example, steel, 90-10 copper-nickel alloy, titanium, and stainless steel.

The combustion chamber assembly 27 can be mounted on the tank 13 by providing a tank mounting flange 47 comprising a cylindrical ring which is fixedly connected to the tank exterior so as to circumscribe the opening 19 in tank 13 and to extend outwardly therefrom generally normal to the vertical sidewalls of tank 13. The tank mounting flange 47 can be provided with a plurality of bores which are suitably spaced and alignable with matching bores provided in tube flange 33, whereby the combustion chamber assembly can be bolted to the tank mounting flange 47. In this way, the combustion chamber assembly 27 is removable from the water tank 13 by detaching the tube mounting flange 33 and sliding the assembly out of the opening 19. Because of the arrangement of opening 19 in the tank 13, the combustion chamber assembly 27 is mounted in a vertical, up-firing position with the longitudinal axis (26 in FIG. 9) of the assembly 27 being perpendicular to the plane of the support area (49 in FIG. 7) of the water heater. The water inlet 15 of the tank 13 is located on the tank sidewalls at a point proximate the exit point of the long legs 41 of the curved fire tubes from the tank interior.

As best seen in FIGS. 8 and 9, at least selected ones of the fire tubes 35 can be provided with baffles 51 to increase flue velocity and increase impingement of flue gases on an inner wall surface (such as surface 53 in FIG. 9). The particular baffles shown in FIG. 9 are corkscrew in shape. As has been briefly mentioned, the fire tube interiors are divided into a condensing region (generally at 55 in FIG. 9), an intermediate region 56, and a non-condensing region 57. Non-metallic baffles can be utilized in the "condensing regions" of the fire tubes. By "condensing region" is meant that the arrangement of the short and long legs 45, 41 of the fire tubes 35 present a region in which the amount of heating surface relative to the Btu/hr input is higher than would be present in a conventional water heater design. As a result, flue products inside the water heater 13 are cooled below their dew point, causing water vapor normally entrained in combustion gases to condense to liquid on the heating surfaces. This phase change releases latent energy that is captured in the water heater and raises thermal efficiency to as high as 95%. Note also that in some instances, cylindrical plastic rods 59 are inserted into at least selected ones of the baffles located inside the fire tube interiors. The plastic rods 59 extend for a part of their length from the fire tube outer extents 60 and for about ¼ of the length of the corkscrew shaped baffles 51 in the embodiment of the invention shown in FIG. 9. The plastic rods 59 force the heat containing flue gases to increase velocity and to move into close proximity of the inner wall heat transfer surfaces of the fire tubes 35, thereby improving heat transfer.

Figure 12:
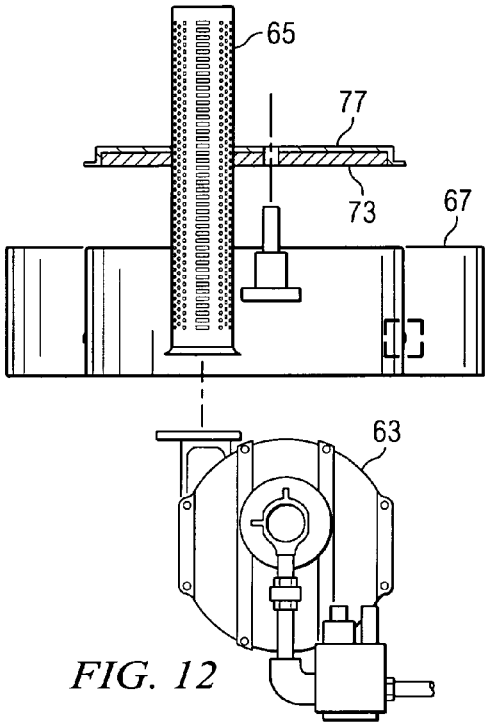
FIG. 12 is an isolated view of the burner and blower assembly showing the assembly of the flue collector thereon.

As can be seen in FIGS. 8, 9 and 12, the water heater 13 has a blower/burner assembly 61 including a blower 63 mounted exterior to the bottom opening 19 of the closed tank and a companion burner 65 mounted at least partly within the combustion chamber submerged portion 27 in an up-firing position for causing combustion to take place within the submerged, pressurized combustion chamber. Heat from the burner/blower assembly 61 passes through the combustion chamber 27, through the fire tubes 35 and into the associated flue/condensate collector 67 to create products of combustion. The location of the cold water inlet 15 for the closed tank is selected to be proximate the exit point of the long legs 41 of the curved fire tubes 35 from the closed tank into the flue/condensate collector so that cold water to be heated is introduced at a point proximate the exit location of the curved fire tubes for maximum heat transfer. Blower/burner assemblies of this general type are described, for example, in U.S. Pat. No. 4,465,024, issued Aug. 14, 1984, to Adams, and assigned to the assignee of the present invention. The particular burner/blower assembly 61 shown in the drawings is commercially available from PVI Industries, LLC, Fort Worth, Tex. 76111, and features a fan-assisted, pre-mix stainless steel ported burner that is lit by a hot surface igniter 69. An electronic flame safeguard continuously monitors combustion.

The flue/condensate collector 67 is mounted on the exterior of the closed tank adjacent the bottom opening 19 thereof. The flue/condensate collector 67 has an annular chamber 71 (see FIGS. 9, 12 and 13) surrounding the exterior mounted blower and separated therefrom. As can be seem in FIG. 9, the annular chamber 71 communicates with each long leg 41 of each of the fire tubes 35 for collecting condensate formed therein as well as the other products of combustion from the chamber 27. The flue/condensate collector 67 is mounted on the tank by means of a circular, flat metal sheet (73 in FIG. 12) which is also used as a lower closure for the normally closed tank as well as for mounting the forced draft burner assembly. The flat metal sheet 73 is gasketed and bolted to the water storage tank bottom mounting flange by means of bolts (75 in FIG. 9). The metal sheet 73 has a refractory blanket lining 77. The use of multiple density refractory provides the benefits of high density refractory in the combustion chamber area, while providing the improved benefit of lower density in the sealing areas adjacent the combustion area. The gasketed design allows easy removability for access to the inner tank surfaces, for example, to apply a verifiable, holiday-free water side tank lining.

Figure 13:
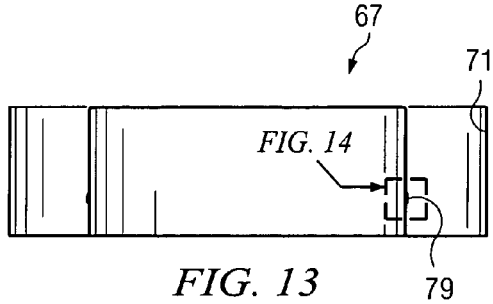
FIG. 13 is an isolated, side view of the flue collector of FIG. 12.
Figure 14:
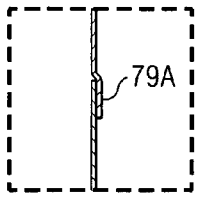
FIG. 14 is a detail view of the sidewall construction of the flue collector of FIG. 13.
Figure 15:
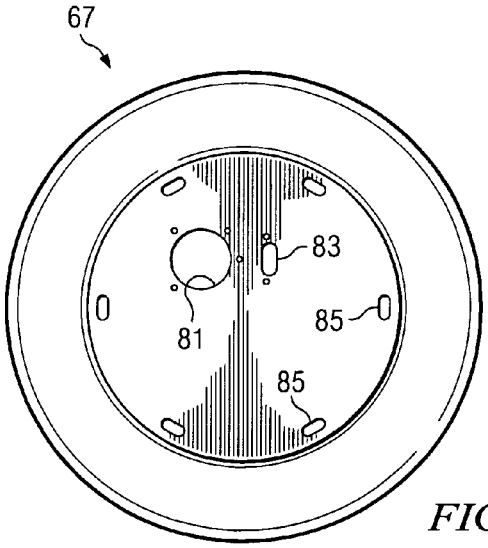
FIG. 15 is a top view of the flue collector of FIG. 13.

As best seen in FIGS. 13-15, the flue/condensate collector 67 is formed as a seamless lower portion with upturned walls so as to facilitate a leak free area without seams where an acidic condensate might collect. In one embodiment, a stainless steel disk is processed to draw flanges on all edges upward from the plane of the disk. To this seamless leak free assembly is attached the flue/condensate collector walls, with welds only on the vertical walls, thus preserving the liquid tight integrity of the seamless lower pan. The upturned and welded wall area 79 is shown in greater detail in FIG. 14. In another embodiment of the invention, the flue/condensate collector is formed of rotomolded plastic able to maintain its mechanical and physical properties in the low flue gas temperatures of a condensing appliance. This flue/condensate collector design may also be formed of reinforced fiberglass or injection molded plastic. If the plastic flue/condensate collector requires additional mechanical strength for attachment to the flue outlet or for attachment of items to the flue/condensate collector, threaded members or reinforcing metal plates may be molded into the plastic used to form the flue/condensate collector. FIG. 15 shows the off-center opening 81 provided in the flue/condensate collector pan for receiving the barrel of the burner 65, as well as the opening 83 provided for the igniter and the circumferentially arranged bolt-hole openings 85 used to attached the flue/condensate collector to the tank mounting flange.

Figure 10:
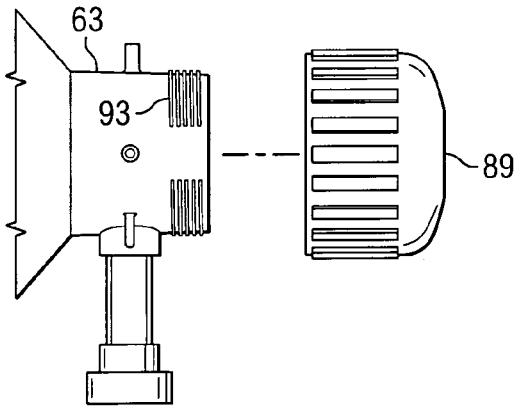
FIG. 10 is a side view of the rear portion of the burner of the water heater of the invention showing the burner air intake orifice fitted with a plastic orifice cap.
Figure 10A:
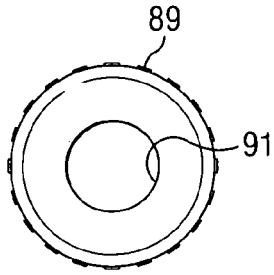
FIG. 10A is an end view of the plastic orifice cap of FIG. 10.
Figure 11:
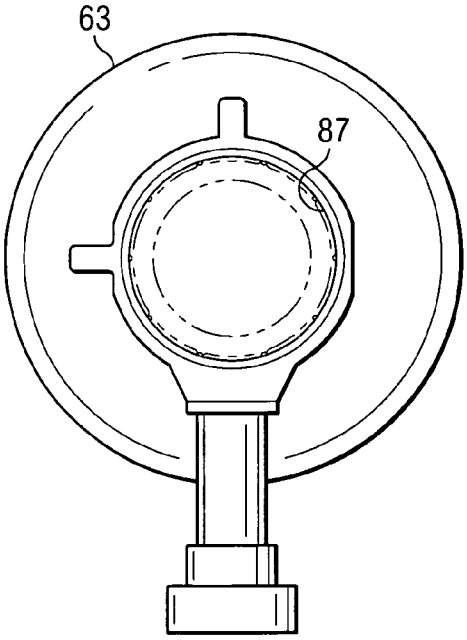
FIG. 11 is an alternative burner construction showing the burner orifice opening thereof.
Figure 11A:
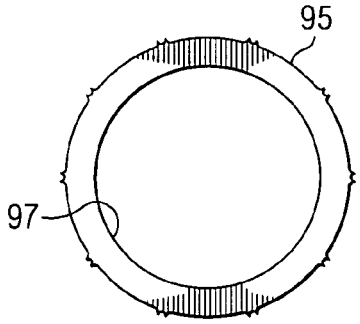
FIG. 11A is an end view of the steel orifice ring which is used with the burner orifice of FIG. 11.

FIGS. 10-11A illustrate another feature of the burner/blower assembly of the invention. The blower portion 63 of the assembly 61 has a blower air inlet (generally at 87 in FIG. 11) for admitting combustion air. In one preferred embodiment of the invention, the blower air inlet 87 is provided with a plastic end cap 89 having an end opening 91 which is of a predetermined orifice size, based upon the combustion air demands of the water heater. The plastic cap 89 shown in FIG. 10 is internally threaded to mate with the external threads 93 provided on the blower. In another embodiment of the invention illustrated in FIGS. 11 and 11A, the blower air inlet opening 87 is fitted with a press fit metal disk (95 in FIG. 11A) with small points on the perimeter to secure the disk inside the blower air inlet 87 in press-fit fashion. The metal disk 95 has an orifice opening 97 of the desired size.

Figure 2:
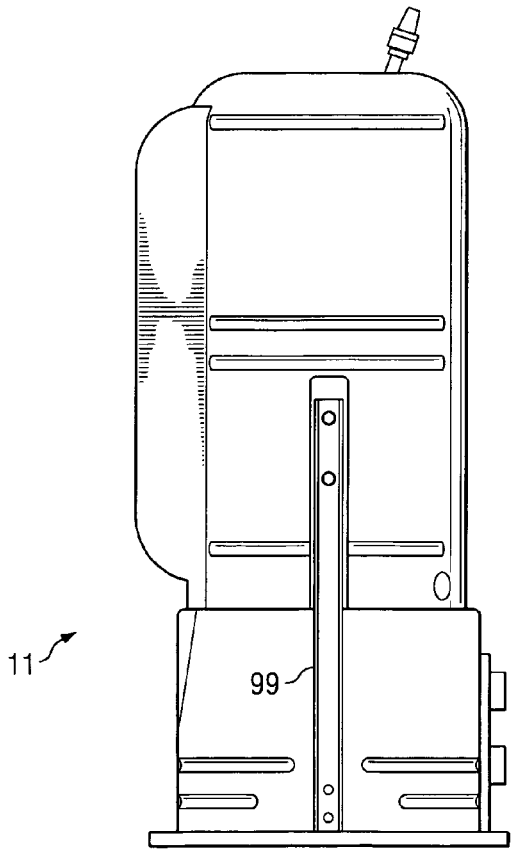
FIG. 2 is a side view of the water heater of FIG. 1.
Figure 7:
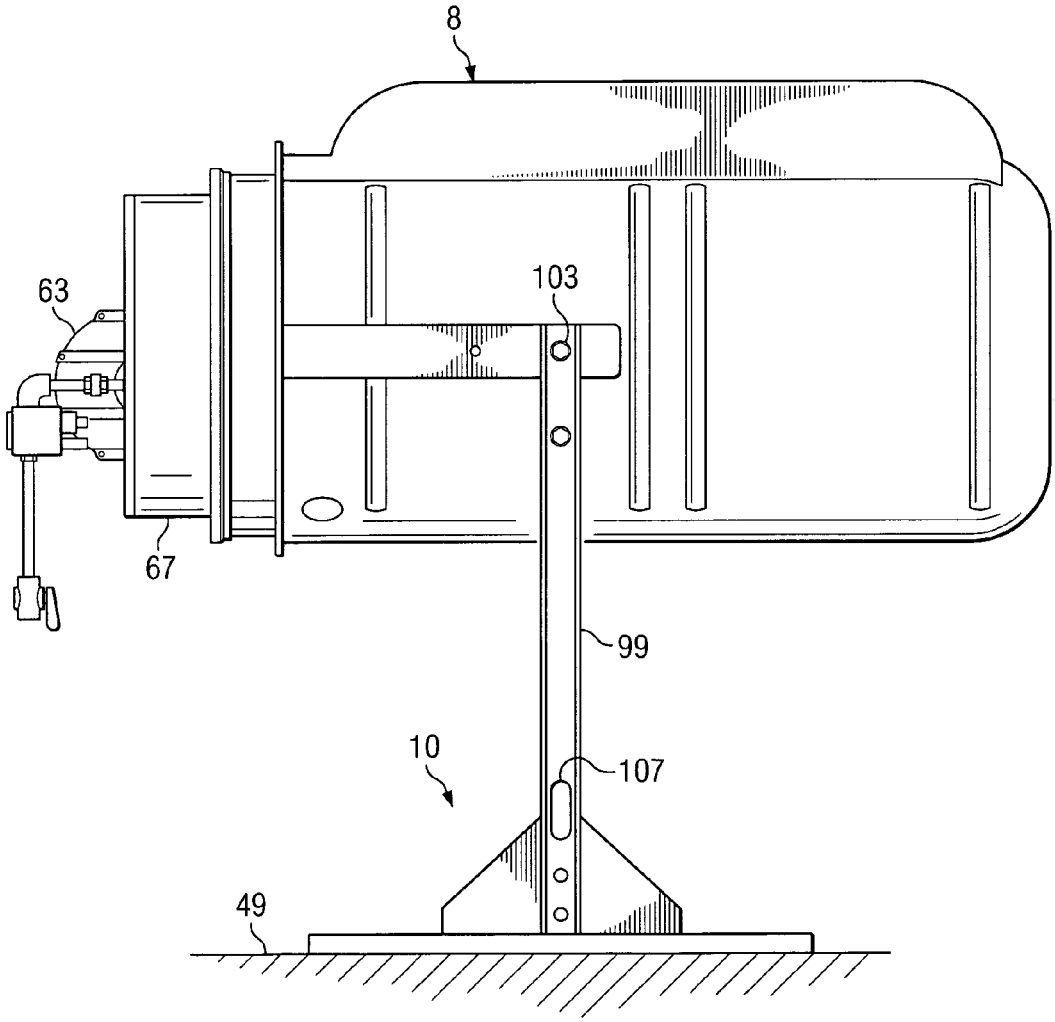
FIG. 7 is a side view of the water heater of FIG. 1 showing the support stand which allows the water heater to be rotated ninety degrees about its normally vertical axis for transport, maintenance or repair operations.

As previously mentioned and as can be seen in FIGS. 1, 2 and 7, the water heater of the invention includes a support stand 10 with oppositely arranged, upwardly extending legs 99, 101 on either of two sides of the closed and jacketed tank 13. The stand is attached to the tank 13 at a pivot point 103 (FIG. 7). This allows the tank 13 to be rotatable about the pivot point 103 between a normal vertical position when in use (FIG. 1), and a horizontal position (shown in FIG. 7). The rotatable nature of the tank provides the ability to lower the overall height of the unit and attached components to clear obstructions such as low doorways, low pipes, low ceilings, etc. during installation of the unit. It also provides easy access to the operating components located at or attached to the lower portion of the appliance. Since the preferred assembly features a combustion chamber and heat transfer tube assembly which is bolted to the lower flange of the tank shell, removal of the assembly is greatly facilitated by rotating the tank to the horizontal position, thereby allowing easy access to the mounting bolts and heat exchanger assembly. The actual attachment points can be attachment bolts (shown as 105 in FIG. 4). The bolt heads are received in mating holes provided in the legs of the stand to allow the tank to pivot about the point 103 in FIG. 7. The pivot bolts 105 can be replaced with eye bolts to provide attachment points for additional seismic attachment. In the embodiment of the device shown in FIG. 7, the leg 99 is provided with a cut-out for routing and exposing the tank utilities, i.e., gas supply line, condensate drain, electrical supply and control power, etc., for servicing.

Figure 3:
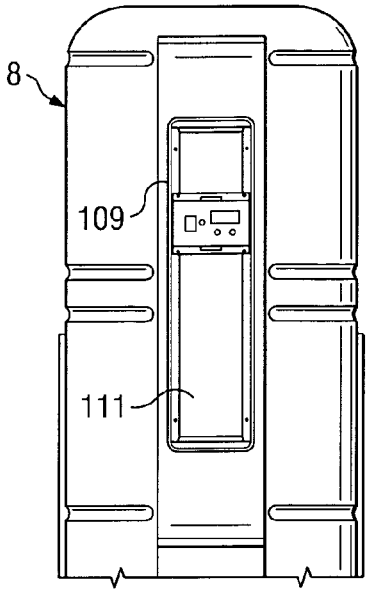
FIG. 3 is a front view of the upper portion of the rotomolded jacket of the water heater of FIG. 1 showing the electrical control panel located thereon.
Figure 4:
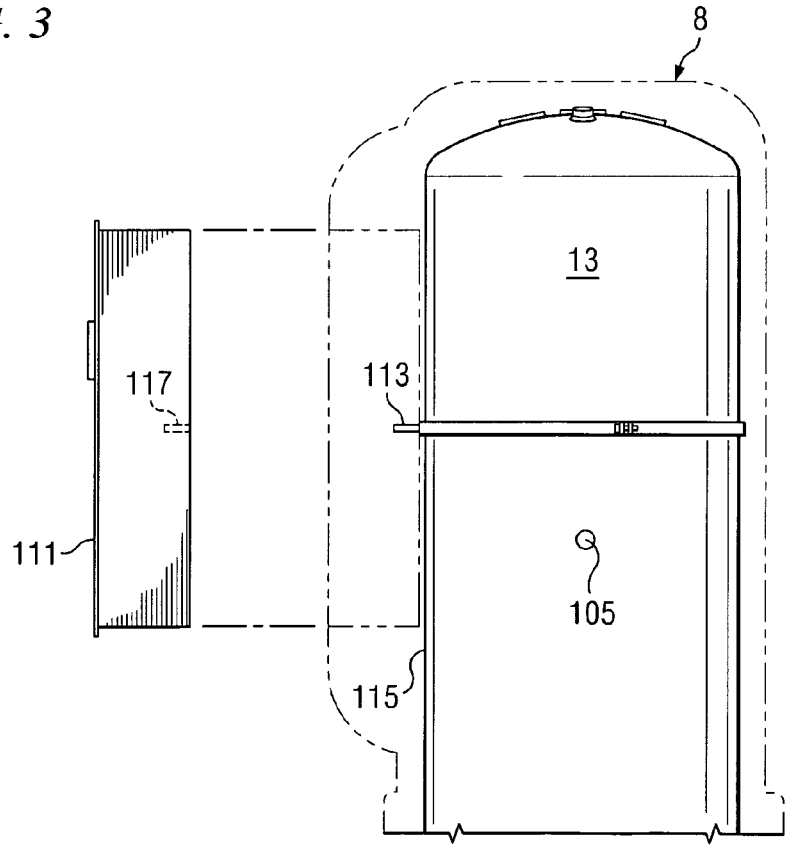
FIG. 4 is a side view of the water heater of FIG. 3 illustrating the installation of the control panel in exploded fashion.

As shown in FIGS. 3 and 4, the rotomolded jacket 8 has an opening 109 for receiving a control panel 111. The electrical control panel 111 is preferably mounted on the rotomolded jacket by means of a mounting stud (113 in FIG. 4) on the closed tank exterior cylindrical sidewalls 115 in cooperation with the positive attachment to a flange surface 117 provided on the control panel. The mounting stud 113 extends outwardly form the tank cylindrical sidewalls generally perpendicular thereto and is capable of being moved up and down vertically and then being fixed (as by tightening screws) in a desired vertical location of the tank exterior. The mating mounting flange surface 117 is lined up and the mounting stud is tightened down. In this way, the control panel 111 is positively attached to the tank sidewalls 115, rather than merely to the rotomolded jacket, thereby meeting the existing electrical code requirements. The use of a floating mounting stud 113, together with the mating attachment flange 117, solves the problem of mounting an electrical enclosure to a flexible and imprecisely located plastic jacket to obtain a secure and cosmetically pleasing fit and finish, while not relying upon the plastic jacket to maintain the mechanical integrity of the electrical enclosure's attachment to the appliance.

Figure 5:
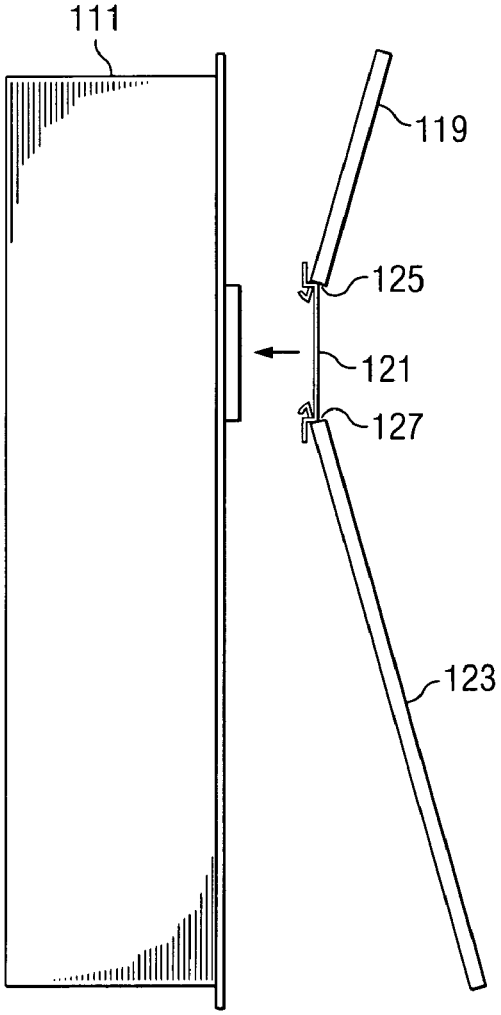
FIG. 5 is a side view of one version of the isolated control panel showing the attachment of the hinged door panels.
Figure 6:
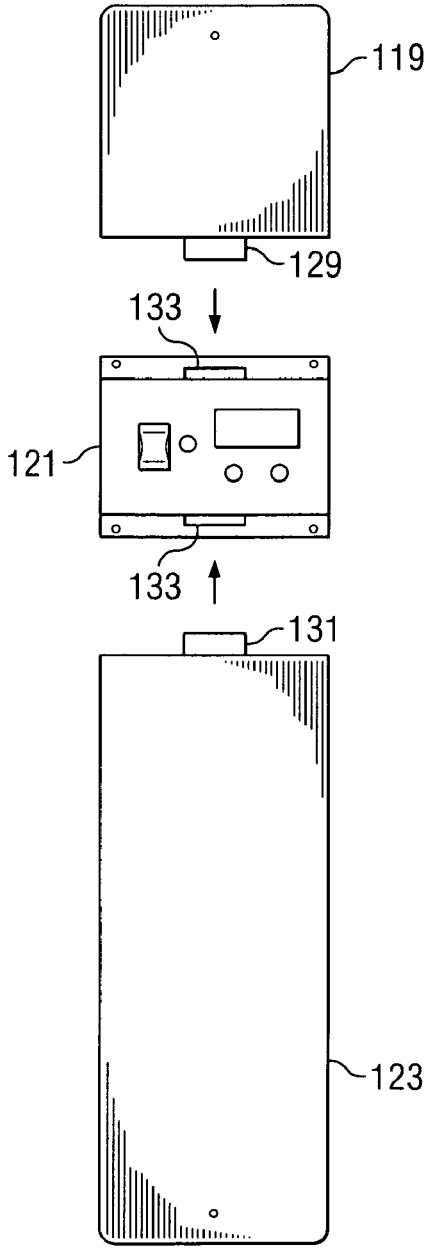
FIG. 6 is a front view of the front panel components of the control panel of FIG. 5.

FIGS. 5 and 6 illustrate one preferred form of the door arrangement for the electrical control panel 111. The door or cover for the panel 111 is divided into a top, middle and bottom sections, 119, 121, 123, respectively. The opposing edges 125, 127 of the top and bottom sections 119, 123, are each provided with a bent metal tang or tab 129, 131, respectively. Each bent tang 129, 131 is received within a mating slot 133, 135 provided in the fixed mid portion 121 of the door. The tangs 129, 131 are designed to be of sufficient length to allow some vertical travel within the slots 133, 135. This allows the door sections 119, 123 to be pivoted between the closed vertical position shown in FIG. 3, and a horizontal position to allow access to the wiring behind the doors.

An invention has been provided with several advantages. The rotatable tank body on its accompanying stand facilitates access to the tank internal components and allows services to be accessed through a suitable leg opening. The rotomolded outer jacket presents a pleasing esthetic appearance for the appliance. The synthetic outer jacket provides several advantages. The jacket can be formed in colored plastic which is resistant to dents and which has the same color throughout the material thickness so that scratching does not change the color. The rotomolded jacket allows the use of metallic and pearlescent additions to the selected color. Labels and decals, accents and styling elements can be molded into the jacket design. Areas can also be left untextured to facilitate label attachment. Areas can be molded flat to improve readability of attached labels. Indexing marks guides can also be formed into the jacket for centering holes or cutouts. Also, bossed or debossed writing can be formed-in. Formed-in bosses or debosses can also be provided to clear tank obstructions or to facilitate attachment to the tank. Formed horizontal, vertical or otherwise angled ribs, members or embossed or debossed impressions can be used to strengthen or reinforce the strength and stability of the plastic jacket, thus allowing the use of thinner jacket materials.

The synthetic jacket is corrosion resistant and make an excellent enclosure for electrical components and wiring because of its non-conductive nature. Raceways can be provided in the molded jacket for wiring, sensing and control connections in addition to such things as fitting escutcheons, tubes and flanges. The risk of standby loss is reduced due to the insulating properties of plastic versus metal enclosure materials. The segmented jacket dramatically reduces assembly time and can be provided at a lower cost than traditional jacketing methods. The rotomolded jacket can be provided at a lower cost when enclosing areas requiring odd shapes or those without a simple frame to which to attach other enclosing materials. The synthetic nature of the jacket provides increased ease of cutting enclosure openings, particularly the ability to cut odd shaped openings through the use of inexpensive tooling and hot knives, saws, routers and other plastic cutting tools. The plastic material is also easy to repair, as by plastic welding, and the use of matching plastic filler helps to eliminate the need to paint or refinish the jacket surface.

The present water heater has a submerged combustion chamber assembly which can be easily removed for repair or replacement. Efficiency is dramatically improved by inserting and sealing the combustion chamber assembly into the water filled tank with the cold water to be heated being introduced near the lowest available point which is therefore at the approximate exit point for all of the heat exchanger tubes. Special baffling in the fire tubes increases flue gas velocity and further increases efficiency. The improved flue/condensate collector with its seamless leak free design resists corrosion due to acid condensate and other factors. The mounting assembly for the burner/blower assembly allows easy removability for access to the inner tank surfaces. The control panel mounting stud arrangement provides an esthetically pleasing fit and finish for the panel while not relying on the plastic jacket to maintain the electrical integrity of the electrical enclosure's attachment to the appliance.

While the invention has been shown in only one of its forms, it is not thus limited but is susceptible to various changes and modifications without departing from the spirit thereof.

What is claimed is:

1. A gas fired water heater, comprising:

a normally closed tank containing water under pressure, the tank having a top wall, depending cylindrical sidewalls and a bottom opening, a water inlet and a water outlet;

a combustion chamber assembly having a submerged, pressurized combustion chamber with multiple external heating surfaces, the combustion chamber normally extending through the bottom opening of the closed tank so that all of the heating surfaces are submerged in the water under pressure;

a forced draft burner assembly mounted on the bottom opening of the closed tank and communicating with the combustion chamber for causing combustion to take place within the submerged, pressurized combustion chamber;

a rotomolded jacket enclosing the normally closed tank; and a support stand with upwardly extending legs on either of two sides of the closed and jacketed tank, the support stand being attached to the closed tank at a pivot point, whereby the tank is rotatable about the pivot point between a vertical position and a horizontal position.

2. The water heater of claim 1, wherein the combustion chamber comprises a substantially cylindrical body portion having an open end located adjacent the closed tank bottom opening and an opposite closed end, and wherein the multiple external heating surfaces comprise a plurality of curved fire tubes, the fire tubes each having a short leg joined to the closed end of the combustion chamber and a long leg which curves downwardly and exits the closed tank adjacent the bottom opening thereof.

3. The water heater of claim 2, further comprising a flue/condensate collector mounted on the exterior of the closed tank adjacent the bottom opening thereof, the flue/condensate collector having an annular chamber surrounding the exterior mounted blower and separated therefrom, the annular chamber communicating with each long leg of each of the fire tubes for collecting condensate formed therein.

4. The water heater of claim 3, wherein the flue/condensate collector is formed as a seamless lower portion with upturned walls so as to facilitate a leak free area without seams where an acidic condensate might collect.

5. The water heater of claim 4, wherein the flue/condensate collector is formed of a material selected from the group consisting of metal, rotomolded plastic, reinforced fiberglass and injection molded plastic.

6. The water heater of claim 2, wherein at least selected ones of the curved fire tubes are provided with baffles to increase flue velocity and increase impingement of flue gasses on an inner wall surface of the fire tubes.

7. The water heater of claim 6, wherein the baffles are corkscrew in shape.

8. The water heater of claim 7, wherein cylindrical plastic rods are inserted inside at least selected ones of the corkscrew baffles located inside the fire tube interiors.

9. The water heater of claim 6, wherein the fire tube interiors are divided into a condensing region and a non-condensing region, and wherein non-metallic plastic baffles are placed in a condensing region of the fire tube interiors.

10. The water heater of claim 1, wherein the water inlet of the closed tank is located on the tank sidewalls at a point proximate the exit point of the long legs of the curved fire tubes from the closed tank into the flue/condensate collector.

11. The water heater of claim 1, wherein the normally closed water storage tank is provided with a bottom mounting flange, and wherein a circular, flat metal sheet is used as a lower closure for the normally closed tank as well as for mounting the forced draft burner assembly, the flat metal sheet being gasketed and bolted to a the water storage tank bottom mounting flange.

12. The water heater of claim 1, wherein an electrical control panel is mounted on the rotomolded jacket by means of a floating mounting stud on the closed tank exterior cylindrical sidewalls in cooperation with a positive attachment to a flange surface molded into the rotomolded plastic jacket.

13. A condensing gas fired water heater, comprising:

a normally closed tank containing water under pressure, the tank having a top wall, depending cylindrical sidewalls and a bottom opening, a water inlet and a water outlet;

a combustion chamber assembly having a submerged, pressurized combustion chamber with multiple external heating surfaces, the combustion chamber normally extending through the bottom opening of the closed tank so that all of the heating surfaces are submerged in the water under pressure, wherein the combustion chamber comprises a substantially cylindrical body portion having an open end located adjacent the closed tank bottom opening and an opposite closed end, and wherein the multiple external heating surfaces comprise a plurality of curved fire tubes, the fires tubes each having a short leg joined to the closed end of the combustion chamber and a long leg which curves downwardly and exits the closed tank adjacent the bottom opening thereof, and wherein the fire tubes have interiors which are divided between condensing and non-condensing regions;

a blower/burner assembly including a blower mounted exterior to the bottom opening of the closed tank and a companion burner mounted at least partly within the combustion chamber in an up-firing position for causing combustion to take place within the submerged, pressurized combustion chamber;

a flue/condensate collector mounted on the exterior of the closed tank adjacent the bottom opening thereof, the flue/condensate collector having an annular chamber surrounding the exterior mounted blower and separated therefrom, the annular chamber communicating with each long leg of each of the fire tubes for collecting condensate formed therein;

a rotomolded jacket enclosing the normally closed tank; and a support stand with upwardly extending legs on either of two sides of the closed and jacketed tank, the support stand being attached to the closed tank at a pivot point, whereby the tank is rotatable about the pivot point between a vertical position and a horizontal position.

14. The condensing water heater of claim 13, wherein the rotomolded jacket enclosing the normally closed tank includes a one-piece upper section and a two-piece clam shell lower enclosure.

15. The condensing water heater of claim 13, wherein the tank is formed of 439 stainless steel.

16. The condensing water heater of claim 13, wherein the support stand is attached on either side of the tank with pivot bolts, the pivot bolts being replacable with eye bolts to provide seismic attachment.

17. The condensing water heater of claim 13, wherein heat from the burner/blower assembly passes through the combustion chamber, through said fire tubes and into the flue/condensate collector to create products of combustion, and wherein the cold water inlet for the closed tank is located on the tank sidewalls at a point proximate the exit point of the long legs of the curved fire tubes from the closed tank into the flue/condensate collector so that cold water to be heated is introduced at a point proximate the exit location of the curved fire tubes.

18. The condensing water heater of claim 17, wherein the flue/condensate collector is formed as a seamless lower portion with upturned walls so as to facilitate a leak free area without seams where an acidic condensate might collect.

19. The condensing water heater of claim 18, wherein the flue/condensate collector is formed of a material selected from the group consisting of metal, rotomolded plastic, reinforced fiberglass and injection molded plastic.

20. The condensing water heater of claim 13, wherein the normally closed water storage tank is provided with a bottom mounting flange, and wherein a circular, flat metal sheet is used as a lower closure for the normally closed tank as well as for mounting the forced draft burner assembly, the flat metal sheet being gasketed in a circumferential gasket region and bolted to a the water storage tank bottom mounting flange.

21. The condensing water heater of claim 20, wherein the flat metal sheet is provided with multiple density refractory, whereby relatively high density refractory is used to insulate the forced draft burner assembly and a relatively lower density refractory is used in the gasket region which is used to seal the water storage tank.

22. The condensing water heater of claim 13, wherein an electrical control panel is mounted on the rotomolded jacket by means of a floating mounting stud on the closed tank exterior cylindrical sidewalls in cooperation with a positive attachment to a flange surface molded into the rotomolded plastic jacket.

23. The condensing water heater of claim 22, wherein the electrical control panel has at least one door section hingedly mounted thereon, the door section having a bent metal tang at one extent thereof which is received within a mating slot provided on a fixed panel section of the door, the tang being provided to be of sufficient length to allow some vertical travel within the mating slot, whereby the door section is pivotable between a closed vertical position and a horizontal position which allows access to an internal region of the panel.

* * * * *